US008398505B2

(12) United States Patent
Tavares et al.

(10) Patent No.: US 8,398,505 B2
(45) **Date of Patent: *Mar. 19, 2013**

(54) GOLF CLUB ASSEMBLY AND GOLF CLUB WITH AERODYNAMIC FEATURES

(75) Inventors: Gary G. Tavares, Southbridge, MA (US); Robert Boyd, Euless, TX (US); John T. Stites, Weatherford, TX (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/427,211

(22) Filed: Mar. 22, 2012

(65) Prior Publication Data

US 2012/0178548 A1 Jul. 12, 2012

Related U.S. Application Data

(63) Continuation of application No. 12/465,164, filed on May 13, 2009, now Pat. No. 8,162,775.

(51) Int. Cl.
*A63B 53/04* (2006.01)

(52) U.S. Cl. ..... 473/327; 473/328

(58) Field of Classification Search ..... 473/324–350, 473/228; D21/752, 759
See application file for complete search history.

(56) References Cited

U.S. PATENT DOCUMENTS

| | | | | |
|---|---|---|---|---|
| 1,587,758 | A | | 6/1926 | Charavay |
| 4,444,392 | A | | 4/1984 | Duclos |
| D275,412 | S | | 9/1984 | Simmons |
| 4,653,756 | A | | 3/1987 | Sato |
| 4,850,593 | A | | 7/1989 | Nelson |
| D307,783 | S | | 5/1990 | Iinuma |
| D310,254 | S | * | 8/1990 | Take et al. ..... D21/752 |
| 5,054,784 | A | | 10/1991 | Collins |
| 5,120,061 | A | | 6/1992 | Tsuchida et al. |
| 5,158,296 | A | | 10/1992 | Lee |
| 5,190,289 | A | | 3/1993 | Nagai et al. |
| 5,193,810 | A | | 3/1993 | Antonious |
| 5,203,565 | A | | 4/1993 | Murray et al. |
| 5,221,086 | A | | 6/1993 | Antonious |

(Continued)

FOREIGN PATENT DOCUMENTS

| | | |
|---|---|---|
| JP | 2009000281 A | 1/2009 |
| WO | 2010028114 A2 | 3/2010 |

(Continued)

OTHER PUBLICATIONS

International Search Report and Written Opinion mailed Apr. 27, 2011 in PCT Application No. PCT/US2011/022311.

(Continued)

*Primary Examiner* — Sebastiano Passaniti
(74) *Attorney, Agent, or Firm* — Banner & Witcoff, Ltd.

(57) ABSTRACT

A golf club head includes a body member having a ball striking face, a crown, a toe, a heel, a sole, and a skirt extending between the crown and the sole and between the toe and the heel. The club head includes a drag-reducing structure that may include one or both of a continuous groove extending from a front portion to a rear edge of the toe, and along an entire length of the skirt, and a substantially V-shaped recess formed in the sole and having a vertex positioned proximate the ball striking face and the heel and away from the skirt and the toe, and a pair of legs extending to a point proximate the toe and away from the ball striking face, and curving toward the skirt and away from the ball striking face.

28 Claims, 4 Drawing Sheets

U.S. PATENT DOCUMENTS

| | | | | | |
|---|---|---|---|---|---|
| 5,240,252 | A | | 8/1993 | Schmidt et al. | |
| D340,493 | S | * | 10/1993 | Murray et al. | D21/752 |
| 5,271,622 | A | | 12/1993 | Rogerson | |
| 5,318,297 | A | | 6/1994 | Davis et al. | |
| D350,176 | S | * | 8/1994 | Antonious | D21/752 |
| D351,441 | S | * | 10/1994 | Iinuma et al. | D21/752 |
| 5,435,558 | A | | 7/1995 | Iriarte | |
| 5,465,970 | A | | 11/1995 | Adams et al. | |
| 5,505,448 | A | | 4/1996 | Park | |
| 5,511,786 | A | | 4/1996 | Antonious | |
| 5,524,890 | A | | 6/1996 | Kim et al. | |
| 5,544,884 | A | | 8/1996 | Hardman | |
| 5,575,725 | A | | 11/1996 | Olsavsky | |
| D379,390 | S | * | 5/1997 | Watanabe et al. | D21/752 |
| 5,643,107 | A | | 7/1997 | Gorman | |
| 5,681,227 | A | | 10/1997 | Sayrizi | |
| D389,886 | S | * | 1/1998 | Kulchar et al. | D21/752 |
| 5,735,754 | A | | 4/1998 | Antonious | |
| 5,785,609 | A | | 7/1998 | Sheets et al. | |
| D398,681 | S | | 9/1998 | Galy | |
| 5,803,830 | A | | 9/1998 | Austin et al. | |
| 5,873,793 | A | | 2/1999 | Swinford | |
| 5,913,733 | A | | 6/1999 | Bamber | |
| 5,921,870 | A | | 7/1999 | Chiasson | |
| 5,954,595 | A | | 9/1999 | Antonious | |
| 5,961,397 | A | | 10/1999 | Lu et al. | |
| 5,980,394 | A | | 11/1999 | Domas | |
| 5,997,413 | A | | 12/1999 | Wood, IV | |
| 5,997,415 | A | | 12/1999 | Wood | |
| 6,017,280 | A | | 1/2000 | Hubert | |
| 6,027,414 | A | | 2/2000 | Koebler | |
| D421,472 | S | | 3/2000 | Peterson | |
| D422,659 | S | * | 4/2000 | Mertens | D21/752 |
| 6,059,669 | A | | 5/2000 | Pearce | |
| 6,074,308 | A | | 6/2000 | Domas | |
| 6,319,148 | B1 | | 11/2001 | Tom | |
| D470,202 | S | | 2/2003 | Tunno | |
| 6,530,847 | B1 | | 3/2003 | Antonious | |
| 6,561,922 | B2 | | 5/2003 | Bamber | |
| 6,609,981 | B2 | | 8/2003 | Hirata | |
| D481,430 | S | | 10/2003 | Tunno | |
| 6,773,359 | B1 | | 8/2004 | Lee | |
| D498,508 | S | * | 11/2004 | Antonious | D21/752 |
| 6,824,474 | B1 | | 11/2004 | Thill | |
| 6,855,068 | B2 | | 2/2005 | Antonious | |
| 6,890,267 | B2 | | 5/2005 | Mahaffey et al. | |
| D509,869 | S | * | 9/2005 | Mahaffey | D21/752 |
| 7,390,266 | B2 | | 6/2008 | Gwon | |
| 7,568,985 | B2 | | 8/2009 | Beach et al. | |
| D608,850 | S | * | 1/2010 | Oldknow | D21/759 |
| D609,296 | S | * | 2/2010 | Oldknow | D21/759 |
| D609,297 | S | | 2/2010 | Oldknow | |
| D609,764 | S | * | 2/2010 | Oldknow | D21/759 |
| 7,713,138 | B2 | | 5/2010 | Sato et al. | |
| D657,838 | S | * | 4/2012 | Oldknow | D21/759 |
| D658,252 | S | * | 4/2012 | Oldknow | D21/759 |
| D659,781 | S | * | 5/2012 | Oldknow | D21/752 |
| D660,931 | S | * | 5/2012 | Oldknow | D21/759 |
| 2001/0027139 | A1 | | 10/2001 | Saso | |
| 2002/0077194 | A1 | | 6/2002 | Carr et al. | |
| 2002/0077195 | A1 | | 6/2002 | Carr et al. | |
| 2003/0087710 | A1 | | 5/2003 | Sheets et al. | |
| 2003/0220154 | A1 | | 11/2003 | Anelli | |
| 2003/0232659 | A1 | | 12/2003 | Mahaffey et al. | |
| 2003/0236131 | A1 | | 12/2003 | Burrows | |
| 2004/0018891 | A1 | | 1/2004 | Antonious | |
| 2004/0138002 | A1 | | 7/2004 | Murray | |
| 2004/0229713 | A1 | | 11/2004 | Helmstetter et al. | |
| 2005/0009622 | A1 | | 1/2005 | Antonious | |
| 2005/0032584 | A1 | | 2/2005 | Van Nimwegen | |
| 2005/0049073 | A1 | | 3/2005 | Herber | |
| 2005/0153798 | A1 | | 7/2005 | Rigoli | |
| 2005/0153799 | A1 | | 7/2005 | Rigoli | |
| 2006/0014588 | A1 | | 1/2006 | Page | |
| 2007/0149310 | A1 | | 6/2007 | Bennett et al. | |
| 2008/0188320 | A1 | | 8/2008 | Kamatari | |
| 2009/0124410 | A1 | | 5/2009 | Rife | |
| 2009/0149276 | A1 | | 6/2009 | Golden et al. | |
| 2009/0203465 | A1 | | 8/2009 | Stites et al. | |
| 2009/0286618 | A1 | | 11/2009 | Beach et al. | |
| 2010/0311517 | A1 | | 12/2010 | Tavares et al. | |
| 2011/0136584 | A1 | * | 6/2011 | Boyd et al. | 473/327 |
| 2011/0281664 | A1 | * | 11/2011 | Boyd et al. | 473/327 |
| 2012/0252597 | A1 | * | 10/2012 | Thomas | 473/327 |
| 2012/0277026 | A1 | * | 11/2012 | Tavares et al. | 473/327 |

FOREIGN PATENT DOCUMENTS

| | | | |
|---|---|---|---|
| WO | 2010104898 | A2 | 9/2010 |

OTHER PUBLICATIONS

International Search Report and Written Opinion mailed Apr. 28, 2011 in PCT Application No. PCT/US2011/022352.

International Search Report and Written Opinion mailed Apr. 27, 2011 in PCT Application No. PCT/US2011/022356.

Adamsgolf, Speedline Driver advertisement, Golf World magazine, Mar. 9, 2009, p. 15.

Achenbach, James, Pros Test New Nike Drivers, Golfweek, Oct. 3, 2009, http://www.golfweek.com/news/2009/oct/12/pros-test-new-nike-drivers/.

International Search Report and Written Opinion issued on Aug. 5, 2010 in PCT Application No. PCT/US2010/034031.

International Search Report and Written Opinion issued on Aug. 5, 2010 in PCT Application No. PCT/US2010/034768.

* cited by examiner

GOLF CLUB ASSEMBLY AND GOLF CLUB WITH AERODYNAMIC FEATURES

RELATED APPLICATIONS

This U.S. patent application is a continuation application of and claims priority to U.S. patent application Ser. No. 12/465,164, filed May 13, 2009, which is entirely incorporated herein by reference.

FIELD

Aspects of this invention relate generally to golf clubs and golf club heads, and, in particular, to a golf club and golf club head with aerodynamic features.

BACKGROUND

The distance a golf ball travels when struck by a golf club is determined in large part by club head speed at the point of impact with the golf ball. Club head speed in turn can be affected by the wind resistance or drag provided by the club head, especially given the large club head size of a driver. The club head of a driver, fairway wood, or metal wood in particular produces significant aerodynamic drag during its swing path. The drag produced by the club head leads to reduced club head speed and, therefore, reduced distance of travel of the golf ball after it has been struck.

Reducing the drag of the club head not only at the point of impact, but also during the swing up until the point of impact with the golf ball, would result in improved club head speed and increased distance of travel of the golf ball. It would be desirable to provide a golf club head that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

The principles of the invention may be used to provide a golf club head with improved aerodynamic performance. In accordance with a first aspect, a golf club head includes a body member having a ball striking face, a toe, a heel, a sole, and a skirt extending between the crown and the sole and between the toe and the heel. A drag reducing structure on the body member is configured to reduce drag for the body member during a golf swing from an end of a backswing through a downswing.

In accordance with another aspect, a golf club head includes a body member having a ball striking face, a toe, a heel, a sole, and a skirt extending between the crown and the sole and between the toe and the heel. A substantially V-shaped recess is formed in the sole and has a vertex positioned proximate the ball striking face and the heel and away from the skirt and the toe. A pair of legs extends to a point proximate the toe and away from the ball striking face, and curves toward the skirt and away from the ball striking face.

In accordance with a further aspect, a golf club assembly includes a shaft and a club head secured to a first end of the shaft. The club head includes a body member having a ball striking face, a toe, a heel, a sole, and a skirt extending between the crown and the sole and between the toe and the heel. A continuous groove extends from a front portion to a rear edge of the toe, and along an entire length of the skirt.

By providing a golf club head with a continuous groove extending from a front portion to a rear edge of the toe, and along an entire length of the skirt according to certain embodiments, the drag of the golf club head during its forward swing up until the point of impact with the golf ball can be reduced. This is highly advantageous since the reduced drag will lead to increased club head speed and, therefore, increased distance of travel of the golf ball after being struck by the club head.

These and additional features and advantages disclosed here will be further understood from the following detailed disclosure of certain embodiments.

Figure 1:
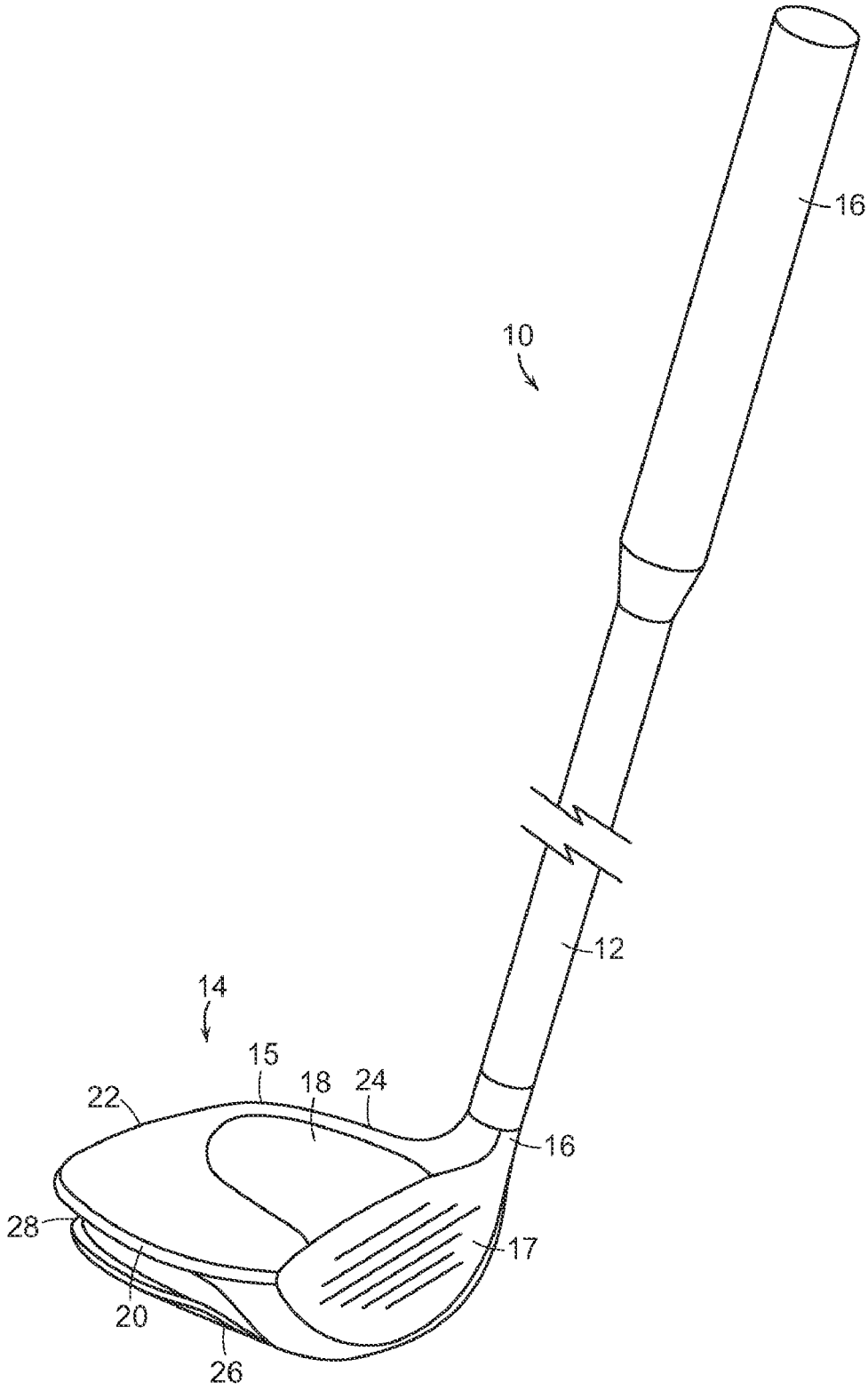
FIG. 1 is a perspective view of a golf club with a groove formed in its club head according to an illustrative aspect.

The figures referred to above are not drawn necessarily to scale, should be understood to provide a representation of particular embodiments of the invention, and are merely conceptual in nature and illustrative of the principles involved. Some features of the golf club head depicted in the drawings have been enlarged or distorted relative to others to facilitate explanation and understanding. The same reference numbers are used in the drawings for similar or identical components and features shown in various alternative embodiments. Golf club heads as disclosed herein would have configurations and components determined, in part, by the intended application and environment in which they are used.

DETAILED DESCRIPTION OF CERTAIN PREFERRED EMBODIMENTS

An illustrative embodiment of a golf club 10 is shown in FIG. 1 and includes a shaft 12 and a golf club head 14 attached to the shaft 12. Golf club head 14 may be any driver, wood, or the like. Shaft 12 of golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors, via friction fits, via retaining element structures, etc.). A grip or other handle element 16 is positioned on shaft 12 to provide a golfer with a slip resistant surface with which to grasp golf club shaft 12. Grip element 16 may be attached to shaft 12 in any desired manner, including in conventional manners known and used in the art (e.g., via adhesives or cements, via threads or other mechanical connectors, via fusing techniques, via friction fits, via retaining element structures, etc.).

Club head 14 includes a body member 15 and a hosel 16 to which shaft 12 is attached in known fashion. Body member 15 includes a plurality of portions or surfaces. As illustrated, this example body member 15 includes a ball striking face 17, a crown 18, a toe 20, a skirt 22, a heel 24, and a sole 26. Skirt 22 is positioned opposite ball striking face 17, and extends between crown 18 and sole 26, and between toe 20 and heel 24.

A drag-reducing structure 27 is provided on body member 15 in order to reduce the drag on club head 14 during a user's golf swing from the end of a user's backswing through the downswing. Drag-reducing element 27 provides reduced drag during the entire downswing of a user's golf swing, not just at the point of impact.

At the point of impact with a golf ball, ball striking face 17 is substantially perpendicular to the direction of travel of club head 14 and the flight of the golf ball. During the user's backswing and during the user's downswing, the user's hand twist golf club 10 such that yaw is introduced, thereby pivoting ball striking face 17 away from its position at impact. With the orientation of ball striking face 17 at the point of impact considered to be 0°, during the backswing ball striking face twists away from the user toward toe 20 and skirt 22 to a maximum of 90° of yaw, at which point heel 24 is the leading edge of club head 24.

Figure 2:
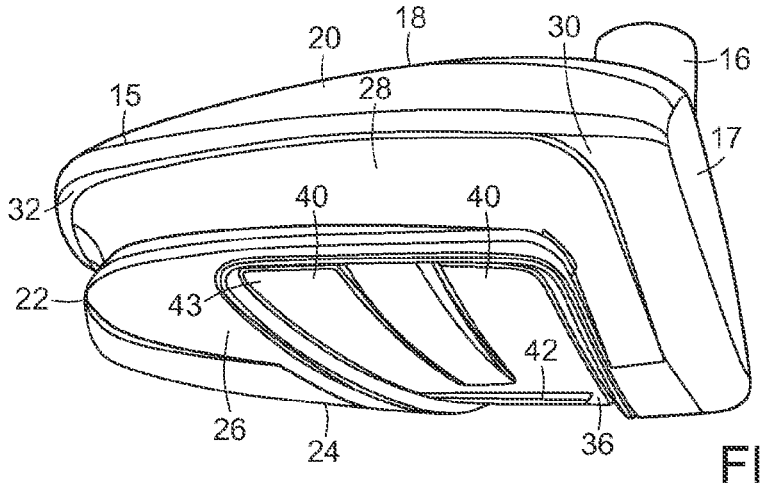
FIG. 2 is a front perspective view of the club head of the golf club of FIG. 1.
Figure 3:
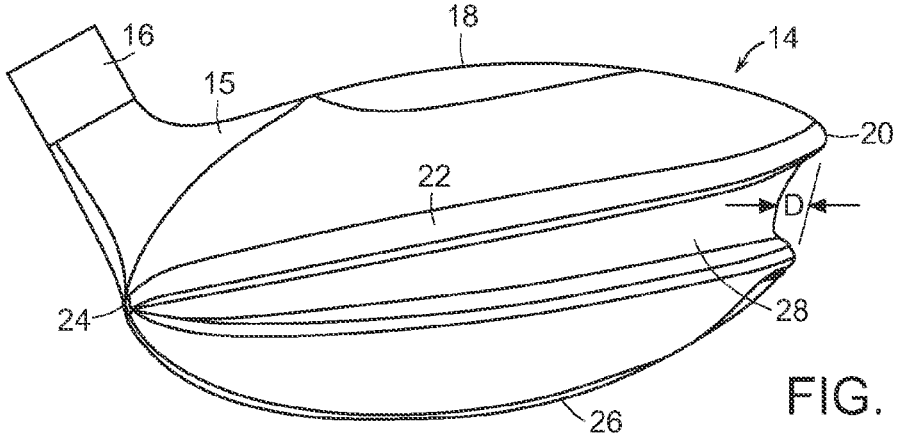
FIG. 3 is a rear perspective view of the club head of the golf club of FIG. 1.
Figure 4:
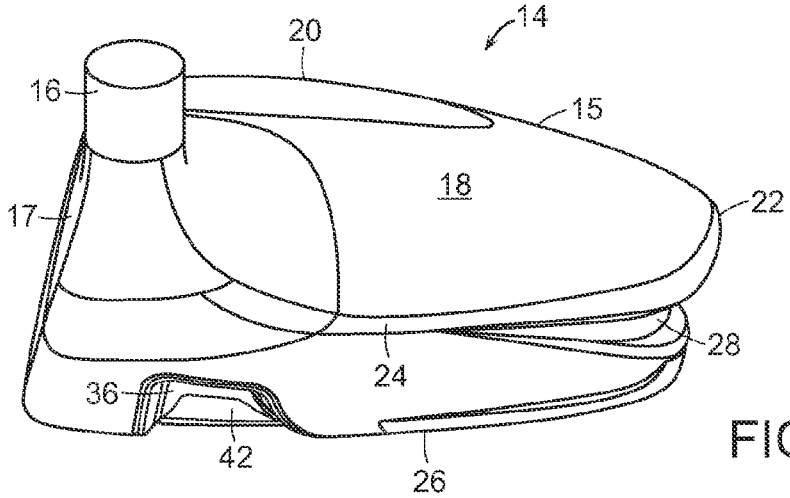
FIG. 4 is a side perspective view of the club head of the golf club of FIG. 1, viewed from a heel side of the club head.

In certain embodiments, drag-reducing structure 27 includes a continuous groove 28 formed about a portion of a periphery of club head 14. As illustrated in FIGS. 2-4, groove 28 extends from a front portion 30 of toe 20 completely to a rear edge 32 of toe 20, and continues on to skirt 22. Groove 28 then extends across the entire length of skirt 22. As can be seen in FIG. 4, groove 28 tapers to an end in a rear portion 34 of heel 24. In certain embodiments, groove 28 at front portion 30 of toe 20 may turn and continue along a portion of sole 26.

In the illustrated embodiment, groove 28 is substantially U-shaped. In certain embodiments, groove 28 has a maximum depth of approximately 15 mm. It is to be appreciated however, that groove 28 may have any depth along its length.

As air flows over crown 18 and sole 26 of body member 15 of club head 14, it tends to separate, which causes increased drag. Groove 28 serves to reduce the tendency of the air to separate, thereby reducing drag and improving the aerodynamics of club head 14, which in turn increases club head speed and the distance that the ball will travel after being struck. Having groove 28 extend along toe 20 is particularly advantageous, since for the majority of the swing path of golf club head 14, the leading portion of club head 14 is heel 24 with the trailing edge of club head 14 being toe 20, as noted above. Thus, the aerodynamic advantage provided by groove 28 along toe 20 is realized during the majority of the swing path. The portion of groove 28 that extends along skirt 22 provides aerodynamic advantage at the point of impact of club head 14 with the ball.

In the embodiment illustrated in FIGS. 1-6, body member 15 is what is known as a square head. Although not a true square in geometric terms, crown 18 and sole 26 of square head body member 15 are substantially square as compared to a traditional round head club.

An example of the reduction in drag during the swing provided by groove 28 is illustrated in the table below. In the table, drag force values are shown for different degrees of yaw throughout the golf swing for both a square head design and for the square head design incorporating the drag-reducing structure of groove 28.

| | Drag Force | | | | | |
|---|---|---|---|---|---|---|
| | Yaw | | | | | |
| | 90° | 70° | 60° | 45° | 20° | 0° |
| Standard | 0 | 3.04 | 3.68 | 8.81 | 8.60 | 8.32 |
| W/Groove | 0 | 1.27 | 1.30 | 3.25 | 3.39 | 4.01 |

It can be seen that at the point of impact, where the yaw angle is 0°, the drag force for the square club head with groove 38 is approximately 48.2% (4.01/8.32) of that of the square club head. However, an integration of the total drag during the entire swing for the square club head provides a total drag force of 544.39, while the total drag for the square club head with groove 38 is 216.75. Thus the total drag force for the square club head with groove 38 is approximately 39.8% (216.75/544.39) of that of the square club head. Thus, integrating the drag force throughout the swing can produce a very different result than calculating the drag force at the point of impact only.

Figure 5:
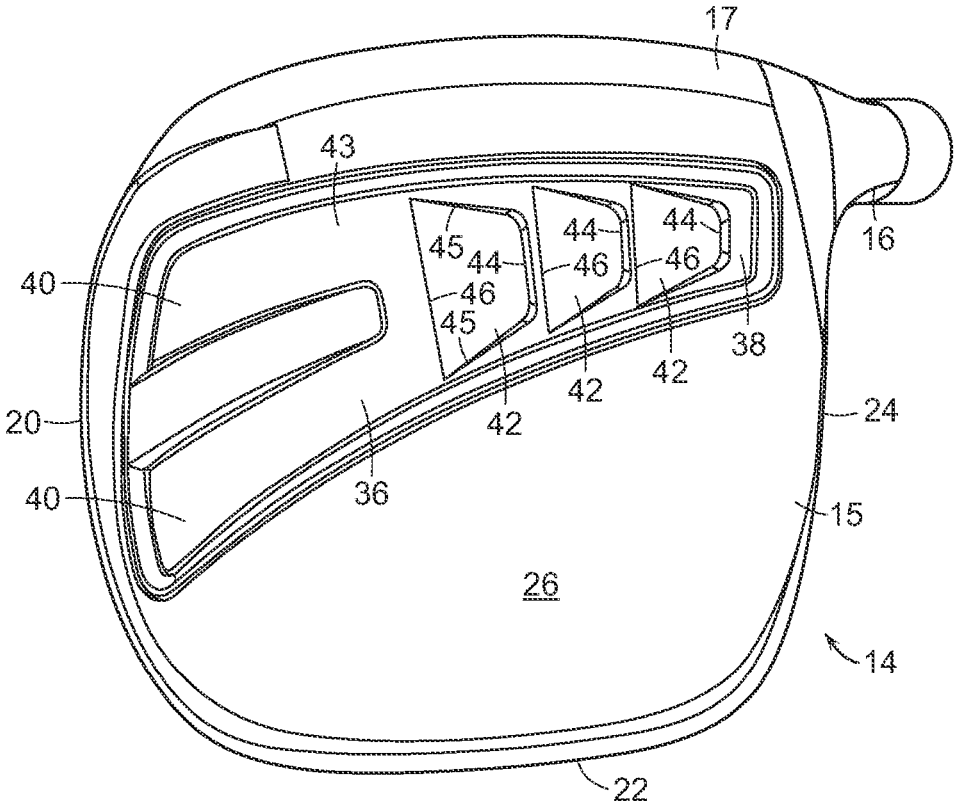
FIG. 5 is a plan view of the sole of the club head of the golf club of FIG. 1.
Figure 6:
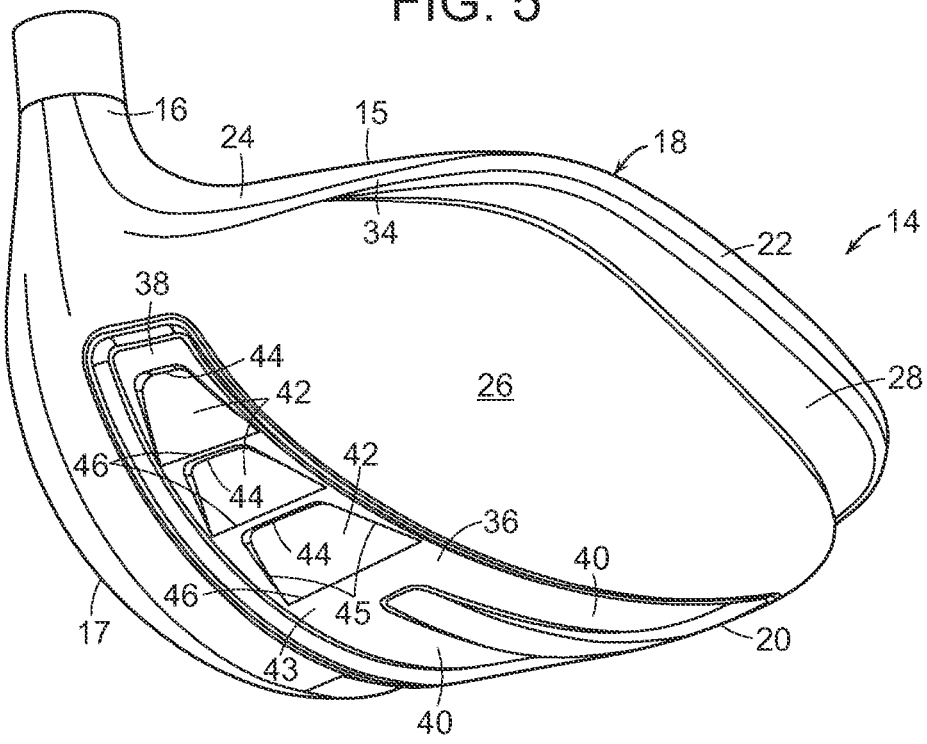
FIG. 6 is a bottom perspective view of the club head of the golf club of FIG. 1.
Figure 8:
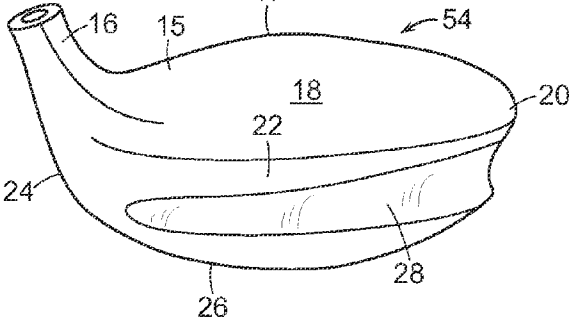
FIG. 8 is a rear perspective view of the club head of FIG. 7.
Figure 7:
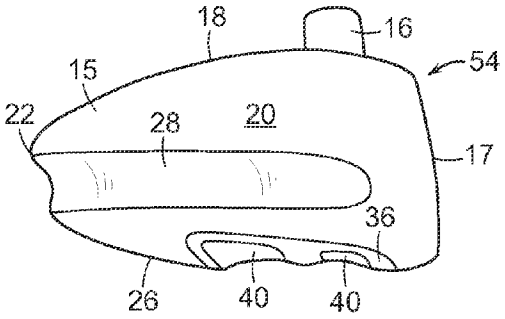
FIG. 7 is a front elevation view of an alternative embodiment of the club head of the golf club of FIG. 1.
Figure 10:
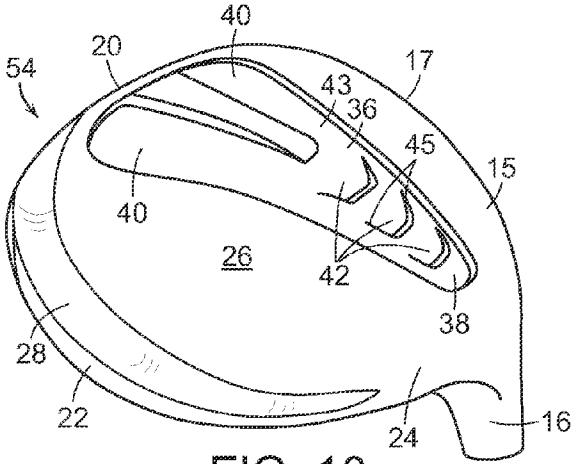
FIG. 10 is a bottom perspective view of the club head of FIG. 7.
Figure 9:
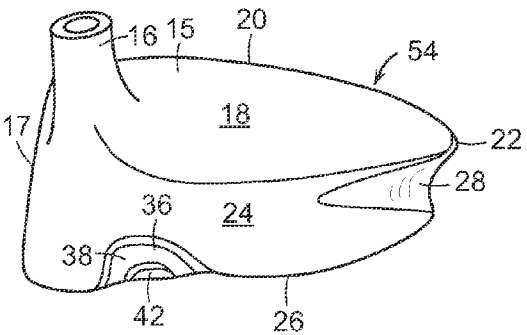
FIG. 9 is a side perspective view of the club head of FIG. 7, viewed from a heel side of the club head.

In certain embodiments, as illustrated in FIGS. 5-6, a recess 36 is formed in sole 26. In the illustrated embodiment, recess 36 is substantially V-shaped with a vertex 38 of its shape being positioned proximate ball striking face 17 and heel 24. That is, vertex 38 is positioned dose to ball striking face 17 and heel 24 and away from skirt 22 and toe 20. Recess 36 includes a pair of legs 40 extending to a point proximate toe 20 and away from ball striking face 17, and curving toward skirt 22 and away from ball striking face 17.

A plurality of secondary recesses 42 is formed in a bottom surface 43 of recess 36. In the illustrated embodiment, each secondary recess 42 is a regular trapezoid, with its smaller base 44 closer to heel surface 24 and its larger base 46 closer to toe surface 20, and angled sides 45 joining smaller base 44 to larger base 46. In the illustrated embodiment a depth of each secondary recess 42 varies from its largest amount at smaller base 44 to larger base 46, which is flush with bottom surface 43 of recess 36.

Another embodiment of a club head 54 is shown in FIGS. 7-10. Club head 54 has a more traditional round head shape. It is to be appreciated that the phrase "round head" does not refer to a head that is completely round but, rather, one with a generally or substantially round profile.

Continuous groove 28 is formed about a portion of a periphery of club head 54. As illustrated in FIGS. 7-10, groove 28 extends from a front portion 30 of toe 20 completely to a rear edge 32 of toe 20, and continues on to skirt 22. Groove 28 then extends across the entire length of skirt 22. As can be seen in FIG. 4, groove 28 tapers to an end in a rear portion 34 of heel 24.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head comprising:

a body member having a ball striking face, a crown, a toe, a heel, a sole, and a skirt extending between the crown and the sole and between the toe and the heel; and a continuous groove extending along a majority of a length of the skirt, wherein the continuous groove further extends to a front portion of the toe, wherein the continuous groove extends from the front portion of the toe onto the sole, and wherein the portion of the continuous groove located on the sole extends substantially parallel to the ball striking face.

2. The golf club head of claim 1, wherein the portion of the continuous groove located on the sole extends substantially perpendicular to the portion of the continuous groove extending along the front portion of the toe.

3. The golf club head of claim 1, wherein the continuous groove converges to a tapered end in a rear portion of the heel.

4. The golf club head of claim 1, wherein the continuous groove has a maximum depth of approximately 15 mm.

5. The golf club head of claim 1, wherein the continuous groove has a substantially U-shaped cross-section.

6. The golf club head of claim 1, wherein the continuous groove is located between a crown edge and a sole edge, and wherein, along the length of the rear skirt, the crown edge extends rearwardly beyond the sole edge.

7. The golf club head of claim 1, wherein the continuous groove is located between a crown edge and a sole edge, and wherein along the toe the crown edge extends beyond the sole edge.

8. The golf club head of claim 1, further comprising a recess formed in a surface of the sole, the recess extending from a first base to a second base, the first base positioned closer to the heel than the second base and having a length smaller than a length of the second base.

9. The golf club head of claim 8, wherein the recess has diverging sides extending from the first base to the second base.

10. The golf club head of claim 8, wherein the recess extends across a majority of a length of the sole from the heel to the toe.

11. A golf club head comprising:

a body member having a ball striking face, a crown, a toe, a heel, a sole; and at least one recess formed in a surface of the sole, the recess extending from a first base toward a second base, the first base positioned closer to the heel than the second base and having a length smaller than a length of the second base, the recess having diverging sides joining the first base to the second base.

12. The golf club head of claim 11, wherein the length of the first base of the recess generally extends in a front-to-rear direction of the club head.

13. The golf club head of claim 11, wherein the length of the second base of the recess generally extends in a front-to-rear direction of the club head.

14. The golf club head of claim 11, wherein the diverging sides of the recess have approximately the same length.

15. The golf club head of claim 11, wherein one of the diverging sides of the recess extends approximately parallel to the ball striking face.

16. The golf club head of claim 11, wherein a majority of the recess is located in a forward half of the golf club head.

17. A golf club head comprising:

a body member having a ball striking face, a crown, a toe, a heel, a sole; and a substantially V-shaped recess formed in a surface of the sole and extending across a majority of the sole from the heel to the toe, the recess having a vertex positioned proximate the heel and a pair of diverging sides.

18. The golf club head of claim 17, wherein one of the diverging sides of the substantially V-shaped recess extends approximately parallel to the ball striking face.

19. The golf club head of claim 17, wherein the substantially V-shaped recess includes a pair of diverging legs extending toward the toe.

20. The golf club head of claim 19, wherein one of the diverging legs of the substantially V-shaped recess extends approximately parallel to the ball striking face.

21. The golf club head of claim 19, wherein each of the diverging legs of the substantially V-shaped recess increases in cross-section as the diverging leg extends toward the toe.

22. The golf club head of claim 17, further comprising a plurality of secondary recesses formed within the substantially V-shaped recess.

23. The golf club head of claim 22, wherein at least one of the plurality of secondary recesses has a trapezoid-shaped bottom surface, with a smaller base of the trapezoid shape positioned closer to the heel and a larger base of the trapezoid shape positioned closer to the toe.

24. The golf club head of claim 23, wherein the smaller base of one of the plurality of secondary recesses is positioned adjacent the larger base of another of the plurality of secondary recesses.

25. The golf club head of claim 22, wherein at least one of the plurality of secondary recesses has a depth that varies as the secondary recess extends toward the toe, the depth being flush with a bottom surface of the V-shaped recess at the end of the secondary recess closer to the toe.

26. A golf club head comprising:

a body member having a ball striking face, a crown, a toe, a heel, a sole, and a skirt extending between the crown and the sole and between the toe and the heel;

a continuous groove extending along a majority of a length of the skirt, wherein the continuous groove further extends to a front portion of the toe, and wherein the continuous groove extends from the front portion of the toe onto the sole; and further comprising a recess formed in a surface of the sole, the recess extending from a first base to a second base, the first base positioned closer to the heel than the second base and having a length smaller than a length of the second base.

27. The golf club head of claim 26, wherein the recess has diverging sides extending from the first base to the second base.

28. The golf club head of claim 26, wherein the recess extends across a majority of a length of the sole from the heel to the toe.

* * * * *